United States Patent [19]

Wieczerniak

[11] 4,244,790

[45] Jan. 13, 1981

[54] COMPOSITION AND METHOD FOR ELECTRODEPOSITION OF BLACK NICKEL

[75] Inventor: Walter J. Wieczerniak, Utica, Mich.

[73] Assignee: Oxy Metal Industries Corporation, Warren, Mich.

[21] Appl. No.: 71,610

[22] Filed: Aug. 31, 1979

[51] Int. Cl.[3] ..... C25D 3/12

[52] U.S. Cl. ..... 204/49

[58] Field of Search ..... 204/49

[56] References Cited

U.S. PATENT DOCUMENTS

| | | | |
|---|---|---|---|
| 2,355,070 | 8/1944 | Harford | 204/49 |
| 2,662,853 | 12/1953 | Ellis | 204/49 |
| 2,836,549 | 5/1958 | Nobel et al. | 204/49 |
| 3,386,897 | 6/1968 | Ostrow et al. | 204/49 |

*Primary Examiner*—Howard S. Williams

*Attorney, Agent, or Firm*—Richard P. Mueller

[57] ABSTRACT

A process and aqueous composition for electrodepositing a uniform, adherent substantially black nickel deposit on a conductive substrate. The aqueous solution is of a pH ranging from about 8 to about 12 and contains nickel ions in combination with a controlled effective amount of a selected class of bath soluble amines to attain the black nickel deposit. The aqueous solution may further optionally contain supplemental darkening enhancing agents, conductivity salts and wetting agents of the types conventionally employed in nickel electroplating solutions.

12 Claims, No Drawings

COMPOSITION AND METHOD FOR ELECTRODEPOSITION OF BLACK NICKEL

BACKGROUND OF THE INVENTION

A variety of processes and solutions have heretofore been used or proposed for use to deposit a dark or substantially black nickel deposit on various conductive substrates. Such so-called black nickel deposits are particularly suitable for various decorative purposes as well as to promote absorption of radiant energy such as in solar heating systems, and the like. Typical of such prior art techniques for depositing a black coating or black nickel deposit on metallic substrates are those disclosed in U.S. Pat. Nos. 2,679,475; 2,844,530; 3,127,279; 3,681,211 and 3,753,873.

A continuing problem associated with such prior art techniques has been the difficulty in controlling the composition and process to consistently achieve substantially black coatings which are adherent to the substrate, which provide for improved corrosion resistance, and which are receptive to receiving a clear lacquer or other siccative finish coating.

The problems and disadvantages associated with known prior art techniques are overcome in accordance with the composition and method of the present invention in which the bath composition can be operated over a broad range of pH, concentration, current density and temperature, and is adaptable for use on a variety of different conductive substrates to consistently produce substantially uniform and adherent substantially black nickel deposits which provide improved corrosion resistance and are also receptive to a variety of clear lacquer finish coats.

SUMMARY OF THE INVENTION

The benefits and advantages of the present invention are achieved by an operating bath which comprises an aqueous solution having a pH ranging from about 4 up to about 12 and containing as its essential constituents, about 2 to about 25 grams per liter (g/l) nickel ions in combination with a bath soluble amine present in an amount to provide a mol ratio of nickel to amine in the solution of from about 1:1 to about 1:4. Bath soluble amines suitable for this purpose are of the formula:

$$R—NH—[(CH_2)_n—NH]_m—(CH_2)_p—X—R'$$

wherein:

n, m and p are integers and n is 2 or 3, m is 1 or 2 or 3, and p is 2 or 3;

X is O or NH; and

R and R' are the same or different and are H, $—CH_2CH=CH_2$, $—CH_2CH_2CH_2SO_3$ or $$—CH_2\underset{\underset{OH}{|}}{C}HCH_2OH$$

Typical of the foregoing amines are triethylene tetramine, dipropylene triamine and 2-(2-amino ethylamino) ethanol.

The operating bath may further optionally contain darkening enhancing agents comprising alkali metal salts of sulfur containing compounds such as thiocyanates, thiosulfates, bisulfites, sulfites and the like, which may be present in amounts up to about 25 g/l. The bath may optionally further contain bath soluble inert salts to increase the conductivity thereof as well as small controlled amounts of wetting agents of the types conventionally employed in nickel electroplating solutions.

In accordance with the method aspects of the present invention, the electroplating bath can operate at from room temperature (70° F.) up to about 150° F. over a current density range of about 2 up to about 25 amperes per square foot (ASF). Plating times can vary from about 1 up to about 10 minutes depending upon bath compositions and process variables.

Additional benefits and advantages of the present invention will become apparent upon a reading of the description of the preferred embodiments taken in conjunction with the specific examples provided.

DESCRIPTION OF THE PREFERRED EMBODIMENTS

The novel electroplating bath of the present invention for depositing so-called black nickel deposits comprises an aqueous solution containing as its essential constituents a controlled effective amount of nickel ions in combination with a bath soluble amine present in a controlled amount depending upon the concentration of nickel ions present. The nickel ion concentration can broadly range from about 2 g/l up to about 25 g/l with amounts ranging from about 6 to about 10 g/l being preferred. Concentration of nickel ions above about 25 g/l is undesirable in some instances in that the nickel deposit formed tends to have a gray appearance at such higher concentrations. The nickel ions can be conveniently introduced into the bath in the form of bath compatible and soluble nickel salts such as nickel sulfate, nickel halide salts, nickel sulfonate, nickel fluoborate, and the like. Of the foregoing, nickel sulfate in the form of the hexahydrate comprises a preferred source. The nickel halide salts can be satisfactorily employed when a nickel anode is employed in the operating bath but are not desirable when inert anodes such as carbon anodes are employed due to the evolution of the corresponding halide gas at the anode. Nickel sulfate provides a further advantage when a nickel anode is employed in that the solution does not as readily attack the surface of the anode and the build-up of nickel ion concentration in the bath is substantially slower providing further simplicity in the control of the operating bath.

The second essential constituent of the electroplating bath is an amine which is compatible and soluble in the operating bath having the formula:

$$R—NH—[(CH_2)_n—NH]_m—(CH_2)_p—X—R'$$

wherein:

n, m and p are integers and n is 2 or 3, m is 1 or 2 or 3, and p is 2 or 3;

X is O or NH; and

R and R' are the same or different and are H, $—CH_2CH=CH_2$, $—CH_2CH_2CH_2SO_3$ or $$—CH_2\underset{\underset{OH}{|}}{C}HCH_2OH$$

Typical amines suitable for use in the bath which correspond to the foregoing formula are triethylene tetramine in which R and R' are H, X is NH, and n, m and p are 2; dipropylene triamine in which R and R' are H, X is NH, m is 1 and n and p are 3; and 2-(2-amino ethylamino) ethanol in which R and R' are H, X is O, m is 1 and n and p are 2.

The concentration of the amine is controlled in relationship to the quantity of nickel ions present in the bath. The mol ratio of nickel ions to amine present in the solution can range from about 1:1 up to about 1:4, preferably 1:1.5 to about 1:2.5 with ratios of about 1:2 being particularly satisfactory. Mol ratios in excess of about 1:4 are undesirable since the high concentration of amine inhibits deposition of nickel from the bath while ratios below about 1:1 do not provide a substantially black nickel deposit.

In addition to the nickel ions and amine as essential bath constituents, the bath may further contain as an optional constituent, bath soluble compatible and inert salts to enhance the conductivity of the electrolyte. Such conductivity salts typically comprise alkali metal sulfate and halides as well as magnesium sulfate and magnesium halide salts. The term "alkali metal" is employed in its broad sense to include the alkali metals sodium, potassium, lithium as well as ammonium.

Such conductivity salts or mixtures thereof can be employed in amounts up to the solubility limit thereof with amounts ranging from about 30 up to about 50 g/l being preferred.

A further optional constituent of the bath comprises a darkening enhancing agent which is present in controlled amounts so as to further enhance the darkness or black finish of the deposit. Darkening enhancing agents suitable for use are alkali metal salts of sulfur containing compounds including thiocyanates, thiosulfates, bisulfites, sulfites, or the like, as well as mixtures thereof. When used, such darkening enhancing agents can be employed in amounts up to about 25 g/l while amounts of about 1 to about 5 g/l are usually preferred. Normally, concentrations of such darkening enhancing agents above about 25 g/l are undesirable due to the degradation products formed by the use of such high concentrations which in some instances impair the uniformity and coverage of the black nickel deposit. In addition, no particular benefits are achieved by employing such agents in amounts greater than 25 g/l in comparison to that obtained when using lesser amounts such as about 5 g/l.

As a further optional constituent, the electroplating bath can incorporate any one of a variety of bath compatible wetting agents in effective amounts of the various types conventionally employed in nickel plating solutions. Normally, wetting agents of the anionic type are employed in concentrations up to about 200 mg/l while amounts of about 50 to about 100 mg/l are preferred. Typical of suitable wetting agents that can be employed are sulfates of primary alcohols containing 8 to 18 carbon atoms such as sodium lauryl sulfate, sodium lauryl ethoxy sulfates or sulfonates and the like.

In accordance with the process aspects of the present invention, the operating bath temperature can range from room temperature (70° F.) up to about 150° F. with temperatures of from about 80° F. to about 90° F. being particularly preferred from an energy conservation standpoint. The particular temperature employed will vary to achieve optimum black nickel deposits depending upon the specific composition and operating conditions employed.

The aqueous operating bath is controlled from a range of about pH 4 up to pH 12 while a pH range of about 6 to about 10 is preferred. Adjustment of the appropriate pH can be achieved employing acids such as sulfuric acid and hydrochloric acid on the one hand, or employing a base such as an alkali hydroxide including ammonium hydroxide.

The electrodeposition of the black nickel deposit can be effected employing an average current density ranging from as low as about 2 up to about 25 ASF. Preferably, the current density is controlled within a range of about 5 to about 15 ASF.

The duration of plating can broadly range from as low as about 1 up to about 10 minutes depending upon the particular bath composition used, the type of the substrate employed, the type of finish desired and the specific current density used. Normally, plating times ranging from about 2 to about 3 minutes are satisfactory.

The electrodeposition of the black nickel coating can be satisfactorily achieved on conductive metal substrates, including nickel, copper, brass, electrodeposited zinc, cadmium, and the like. In order to achieve a lustrous bright, substantially black nickel deposit, it is preferred that the substrate be in a bright condition either by depositing a bright electrodeposit on the surface or by mechanical means such as buffing, or the like. As the substrate becomes less bright, then the resultant nickel deposit tends to progressively become grayer.

In order to further illustrate the composition and method of the present invention, the following examples are provided. It will be understood that the examples are provided for illustrative purposes and are not intended to be limiting of the scope of the present invention as herein described and as set forth in the subjoined claims.

EXAMPLE I

An electroplating solution is made up consisting of 26 g/l $NiSO_4.6H_2O$ and 26 g/l of triethylene tetramine. The pH of the solution is adjusted to 12 with NaOH. A freshly prepared bright nickel plated work piece is immersed into the solution and connected to the cathode pole of a power source. Carbon rods are connected to the anode pole of the power source to complete the circuit. The work piece is plated for 2–3 minutes at 15 ASF at 75° F. The deposit is uniformly black with good adhesion.

EXAMPLE II

An electroplating solution is made up consisting of 26 g/l $NiSO_4.6H_2O$ and 26 g/l of dipropylene triamine. The pH of the solution is adjusted to 4 with $H_2SO_4$. A freshly prepared bright nickel plated work piece is immersed into the solution and plated for 2–3 minutes at 15 ASF and 75° F. The deposit is uniformly black with good adhesion.

EXAMPLE III

An electroplating solution is made up consisting of 26 g/l $NiSO_4.6H_2O$ and 21 g/l of 2-(2-aminoethylamino) ethanol. The pH of the solution is adjusted to 12 with NaOH. A freshly prepared bright nickel plated work piece is immersed into the solution and plated for 2–3 minutes at 15 ASF and 75° F. The deposit is uniformly black with good adhesion.

EXAMPLE IV

An electroplating solution is made up consisting of 26 g/l $NiSO_4.6H_2O$, 21 g/l of 2(2-aminoethylamino) ethanol and 5 g/l of NaCNS. The pH of the solution is adjusted to 12 with NaOH. A freshly prepared bright nickel plated work piece is immersed into the solution and plated for 2–3 minutes at 15 ASF and 75° F. The deposit is uniformly black with good adhesion.

EXAMPLE V

An electroplating solution is made up consisting of 26 g/l $NiSO_4.6H_2O$, 21 g/l of 2(2-aminoethylamino) ethanol and 10 g/l of $Na_2S_2O_3$. The pH of the solution is adjusted to 12 with NaOH. A freshly prepared nickel work piece is immersed into the solution and plated for 2–3 minutes at 15 ASF and 75° F. The deposit is uniformly black with good adhesion.

The addition of either sodium thiocyanate or sodium thiosulfate to the electroplating solution of Examples IV and V serve as a darkening enhancing agent and the nickel deposits obtained in Examples IV and V are much darker than that obtained with the identical solution of Example III but devoid of any darkening enhancing agent.

EXAMPLE VI

An electroplating solution is prepared, consisting of 25 g/l Ni $(NH_2SO_3)_2$, 21 g/l of 2(2-aminoethylamino) ethanol and 5 g/l of NaCNS. The pH is adjusted to 6 with $H_2SO_4$. A freshly prepared nickel work piece is immersed into the solution and plated for 2 to 3 minutes at 10 ASF and 75° F. The deposit is uniformly black with good adhesion.

EXAMPLE VII

An electroplating solution is prepared consisting of 23 g/l $Ni(BF_4)_2$, 21 g/l of 2 (2-aminoethylamino) ethanol and 5 g/l of NaCNS. The pH is adjusted to 6 with $H_2SO_4$. A freshly prepared nickel workpiece is immersed into the solution and plated for 2 to 3 minutes at 10 ASF and 75° F. The deposit is uniformly black with good adhesion.

EXAMPLE VIII

An electroplating solution is prepared consisting of 24 g/l of $NiCl_2.6H_2O$, 21 g/l of 2 (2-aminoethylamino) ethanol, and 5 g/l of NaCNS. The pH is adjusted to 6 with $H_2SO_4$. A freshly prepared nickel workpiece is immersed into the solution and plated for 2 to 3 minutes at 10 ASF and 75° F. The deposit is uniformly black with good adhesion.

EXAMPLE IX

An electroplating solution is prepared consisting of 17 g/l $NiSO_4.6H_2O$, 14 g/l of 2 (2-aminoethylamino) ethanol, 5 g/l of NaCNS, 40 g/l of $Na_2SO_4$, and 0.2 g/l of an anionic wetting agent, sodium lauryl sulfate. The pH is adjusted to 6 with $H_2SO_4$. A freshly prepared nickel workpiece is immersed into the solution and plated for 2 to 3 minutes at 10 ASF and 75° F. The deposit is uniformly black with good adhesion.

EXAMPLE X

An electroplating solution is prepared consisting of 40 g/l $NiSO_4.6H_2O$, 33 g/l of 2 (2-aminoethylamino) ethanol, 5 g/l of NaCNS, 30 g/l of $Na_2SO_4$, and 0.1 g/l of an anionic wetting agent, sodium lauryl ethoxy sulfate. The pH is adjusted to 6 with $H_2SO_4$. A freshly prepared nickel workpiece is immersed into the solution and plated for 2 to 3 minutes at 10 ASF and 75° F. The deposit is uniformly black with good adhesion.

EXAMPLE XI

An electroplating solution is prepared consisting of 26 g/l $NiSO_4.6H_2O$, 21 g/l of 2 (2-aminoethylamino) ethanol, 5 g/l NaCNS, 40 g/l of $Na_2SO_4$, and 0.2 g/l of sodium lauryl sulfate. The pH is adjusted to 6 with $H_2SO_4$. A freshly prepared nickel workpiece is immersed into the solution and plated for 2–3 minutes at 10 ASF and 150° F. The deposit is black with good adhesion.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A bath for electrodepositing a substantially black nickel deposit on a substrate comprising an aqueous solution having a pH of about 4 to about 12 and containing about 2 to about 25 g/l nickel ions, and a bath soluble amine present in an amount to provide a mol ratio of nickel to amine in the solution of about 1:1 to about 1:4, said amine corresponding to the formula:

$$R—NH—[(CH_2)_n—NH]_m—(CH_2)_p—X—R'$$

wherein:

n, m and p are integers and n is 2 or 3, m is 1 or 2 or 3, and p is 2 or 3;

X is O or NH; and

R and R′ are the same or different and are H, $—CH_2CH{=}CH_2$, $—CH_2CH_2CH_2SO_3$ or $$—CH_2\underset{\underset{OH}{|}}{C}HCH_2OH$$

2. The bath as defined in claim 1 in which said nickel ions are present in an amount of about 6 to about 10 g/l.

3. The bath as defined in claim 1 in which said amine is present to provide a mole ratio of nickel to amine of about 1:1.5 to about 1:2.5.

4. The bath as defined in claim 1 in which said amine is present to provide a mol ratio of nickel to amine of about 1:2.

5. The bath as defined in claim 1 further including bath soluble and compatible inert conductivity salts present in an amount up to their solubility limit in the bath.

6. The bath as defined in claim 5, in which the bath soluble and compatible inert conductivity salts are selected from alkali metal sulfates, alkali metal halides, magnesium sulfate, magnesium halides and mixtures thereof and are present in an amount of about 30 to about 50 g/l.

7. The bath as defined in claim 1 further including as a darkening enhancing agent an alkali metal sulfur compound selected from the group consisting of thiocyanates, thiosulfates, bisulfites, sulfites, and mixtures thereof present in an amount up to about 25 g/l.

8. The bath as defined in claim 7 in which said darkening enhancing agent is present in an amount of about 1 to about 5 g/l.

9. The bath as defined in claim 1 further including up to about 200 mg/l of a bath compatible wetting agent.

10. The bath as defined in claim 9 in which said wetting agent is an anionic wetting agent and is present in an amount of about 50 to about 100 mg/l.

11. The bath as defined in claim 1 in which said amine is selected from the group consisting of triethylene tetramine, dipropylene triamine, 2-(2-amino ethylamino) ethanol, and mixtures thereof.

12. A method for electrodepositing a substantially black nickel deposit on a substrate which comprises the steps of electrodepositing nickel at a current density of about 2 to about 25 ASF for a period of time sufficient to deposit the desired thickness of deposit from an aqueous solution as defined in claim 1 or 2 or 3 or 4 or 5 or 6 or 7 or 8 or 9 or 10 or 11 at a temperature of about room temperature up to about 150° F.

* * * * *